United States Patent [19]

Strugielski et al.

[11] 4,114,540

[45] Sep. 19, 1978

[54] RAILWAY TRUCK BOLSTER

[75] Inventors: Ronald T. Strugielski, Evanston, Ill.; Harry William Mulcahy, Griffith, Ind.

[73] Assignee: AMSTED Industries Incorporated, Chicago, Ill.

[21] Appl. No.: 801,599

[22] Filed: May 31, 1977

[51] Int. Cl.[2] ..... B61F 1/12; B61F 5/16; B61F 5/50; F16C 17/04

[52] U.S. Cl. ..... 105/226; 105/230

[58] Field of Search ..... 105/226, 230

[56] References Cited

U.S. PATENT DOCUMENTS

| | | | |
|---|---|---|---|
| 632,426 | 9/1899 | Player | 105/230 |
| 768,901 | 8/1904 | Hopkins | 105/230 |
| 831,251 | 9/1906 | Stucki | 105/230 |
| 972,768 | 10/1910 | Krakau | 105/230 X |
| 1,101,028 | 6/1914 | Johnson et al. | 105/230 |
| 1,902,807 | 3/1933 | Dreibuss et al. | 105/230 |
| 1,969,131 | 8/1934 | Hedgcock et al. | 105/230 |
| 1,985,469 | 12/1934 | Symington | 105/230 |
| 3,338,183 | 8/1967 | Boissier | 105/230 X |

*Primary Examiner*—Drayton E. Hoffman
*Assistant Examiner*—Howard Beltran
*Attorney, Agent, or Firm*—John L. Schmitt; Fred P. Kostka

[57] ABSTRACT

A bolster for a railway car truck having an obstacle-free cavity located below a center plate so as to more readily accommodate truck linkage members, brake apparatus and other associated mechanical components. The obstacle-free cavity is defined by a top and a bottom member, sidewalls each having an elliptical opening therein and two spaced vertically inclined lateral ribs which distribute the weight of a body of the car between the top and bottom members.

5 Claims, 5 Drawing Figures

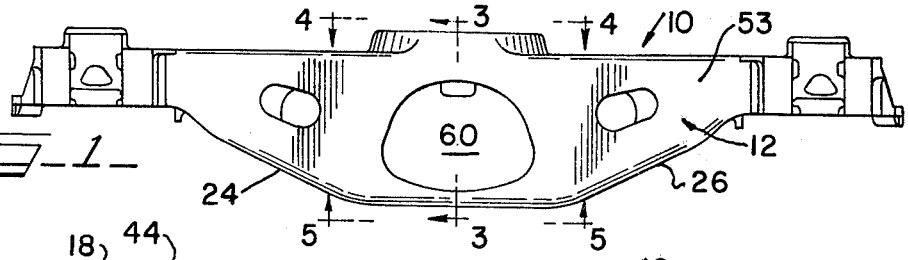
FIG. 1
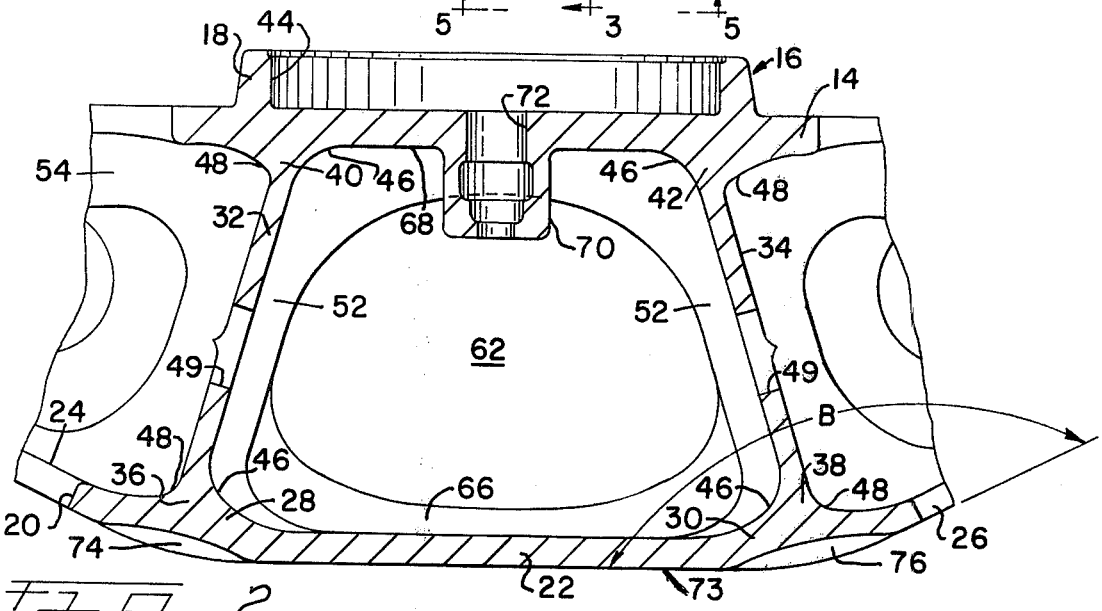
FIG. 2
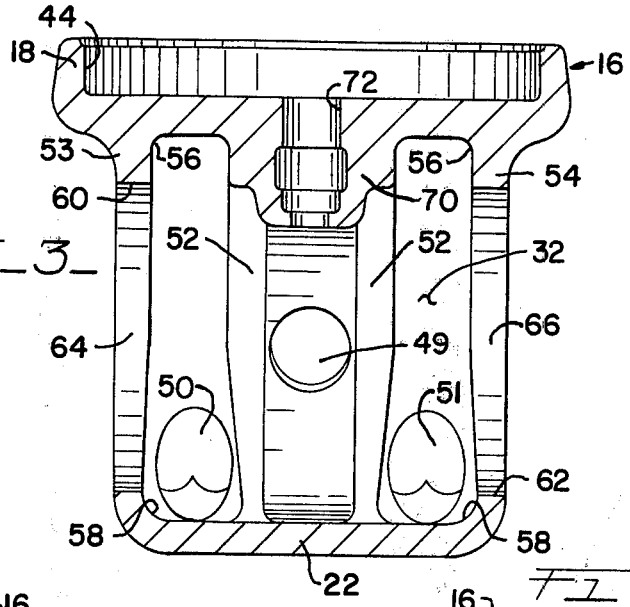
FIG. 3
FIG. 4
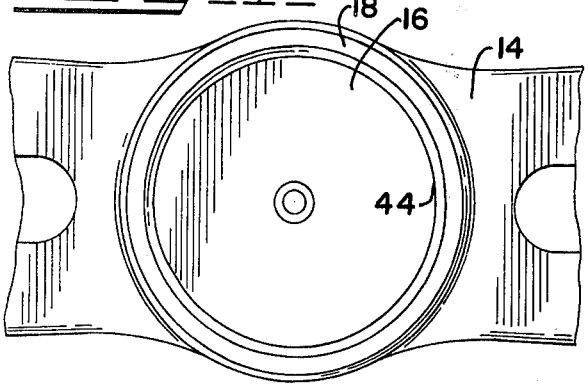
FIG. 5
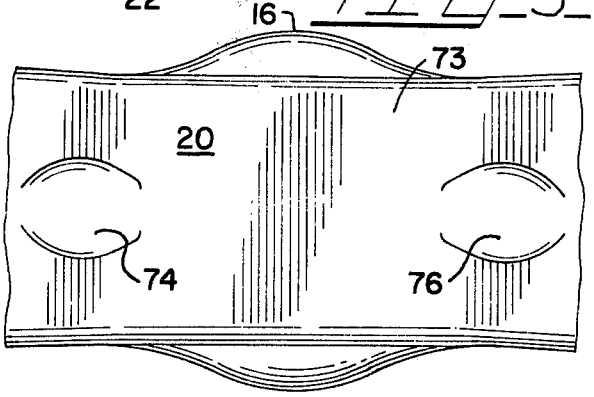

RAILWAY TRUCK BOLSTER

BACKGROUND OF THE INVENTION

1. Field of the Invention

This invention relates to railway car trucks and particularly to a configuration of a truck bolster which provides an obstacle-free opening below a center plate on the bolster.

2. Prior Art

Heretofore, bolsters used in railway car trucks were provided in a tubular construction where a center portion of the bolster below the center plate on the bolster had vertical sidewalls joining a top and a bottom member of the bolster. Holes were provided in the sidewall to allow access to the space and accommodate, as an example, various components of a braking system of the car.

Additionally, it was not uncommon to provide both lateral and longitudinal vertical reinforcing ribs within the center portion.

SUMMARY OF THE INVENTION

A bolster particularly adapted for use in a truck for a railway car is provided with a near obstacle-free opening below a center plate on the bolster.

The near obstacle-free opening is defined by a horizontal top member in which the center plate may be integrally formed, a horizontal bottom member having a longitudinal dimension somewhat greater than that of the top member, spaced vertically inclined lateral ribs having a top and bottom end joining the top and bottom members respectively. Sidewalls having therein a substantially elliptical-like opening to define vertical reinforcing rims about the cavity may be added to further strengthen the bolster and thereby allow a reduction in size of the other structural elements.

The bolster structure of this invention provides several important advantages over the structure of the prior art.

First, the truck bolster has a mechanical strength proximating that of bolsters not having a center opening yet offers a near obstacle-free space below the center plate of sufficient size to easily accommodate various mechanical components which may be required to accommodate braking system components, truck linkages and the like.

Another major advantage of the structure of this invention is that the longitudinal and laterally spaced vertical ribs normally associated with a center portion of a truck bolster have been removed so as to reduce the weight and thereby correspondingly reduce its material cost and cost of manufacture.

BRIEF DESCRIPTION OF THE DRAWINGS

FIG. 1 is an elevational view of the bolster of this invention.

FIG. 2 is a fragmentary elevational view partially in cross section of the center portion of the bolster of FIG. 1.

FIG. 3 is a fragmentary cross sectional elevational view taken generally along the lines 3—3 of FIG. 1.

FIG. 4 is a fragmentary top view of the bolster taken generally along the lines 4—4 of FIG. 1; and FIG. 5 is a fragmentary bottom view of the bolster taken generally along the lines 5—5 of FIG. 1.

DESCRIPTION OF THE PREFERRED EMBODIMENT

A railway car bolster, shown generally at 10, includes an elongated body 12 made by casting from steel or the like and having a length proximately 70 percent greater than the standard gauge track width. The body 12 is generally hollow, rectangular in cross section and includes a horizontal top member 14 with a center plate 16 formed thereon having a peripheral rim 18 to receive therein a center plate on a railway car body [not shown].

Below the top member 14 is an inverted gullwing shaped bottom member 20 having a horizontal center portion 22 and right and left upwardly inclined intermediate portions 24 and 26 joining ends 28 and 30 of the center portion 22 to form an inner obtuse angle B with a plane of the center portion. The obtuse angle B proximates 155°. The length of the center portion 22 of the bottom flange 20 is selected to be greater than an outside diameter of the rim 18 of the center plate 16 and has a length which proximates 25 percent of the total length of the bolster body 12. The vertical distance between the top member 14 and the center portion 22 of the bottom member 20 proximates 15 percent of the total length of the bolster body 12.

Integral with and extending between the top member 14 and the bottom member 20 are right and left laterally spaced ribs 32 and 34. Each rib 32 and 34 has a lower end 36 and 38 which joins the bottom member 20 at a junction of the center portion 22 and the intermediate portions 24 and 26, respectively, and is positioned such that a plane of each rib 32 and 34 proximately bisects the obtuse angle B respectively. An upper end 40 and 42 of each rib 32 and 34 joins the top member 14 of the bolster body 12 at a point below the center plate 16 and proximately aligns with an inner surface 44 of the center plate rim 18.

Because of the integral construction of the bolster body 12, junctions between the lower ends 36 and 38 of the ribs 32 and 34 and the bottom member 20 and the upper ends 40 and 42 and the top member 14 form inner and outer radius corners 46 and 48 having substantial diameters.

Each rib 32 and 34 is provided with three holes 49, 50 and 51. The hole 49 is circular and located at a proximate center point of each rib 32 and 34 while the holes 50 and 51 are elliptical-like and located at respective outer lower corners of each rib 32 and 34. Separating each hole 49 from the holes 50 and 51 is a pair of vertical gussets 52 which joins the bottom member on a substantial radius and extends beneath the top member 14.

Integrally joining the top and bottom members 14 and 20 and ribs 32 and 34 is a front and rear vertical sidewall 53 and 54, respectively, forming a junction having an inner top radius 56 and an inner bottom radius 58. Within each sidewall 53 and 54 is an elliptical-like opening 60 and 62 having a lengthwise or major dimension proximating an inside diameter of the center plate 16 and a height or minor dimension proximating 80 percent of the distance between the top and bottom members such that a substantial reinforcing rim 64 and 66 is formed between the respective openings 60 and 62, the top member 14, the bottom member 20 and the ribs 32 and 34. It should be understood that the use of sidewalls 53, 54 is optional.

On an inner surface 68 of the top member 14 there is integrally formed a downward projecting hub 70 containing therein an elongated aperture 72 for accommodating a center pin (not shown) of the railway car body.

On the outer surface 73 of the bottom member 20 are two spaced indentations of cavities 74 and 76 each having its longitudinal axis aligned with a longitudinal axis of the bolster body 12 and positioned to proximately align with the respective lower ends 36 and 38 of the ribs 32 and 34. These indentations 74 and 76 are shaped to provide a varying thickness which serves to distribute a load applied to the center plate 16 and transferred to the bottom member 22 by the ribs 32 and 34 outwardly toward sidewalls 53 and 54.

While various modifications may be suggested by those versed in the art, it should be appreciated that I wish to embody within the scope of the patent warranted hereon all such modifications as reasonably and properly come within the scope of my contribution to the art.

What is claimed is:

1. A truck bolster for a railway car truck having an elongated hollow compartmentalized body comprising, a substantially rectilinear-shaped center cavity defined only by a substantially horizontal top member having a center plate formed on an upper surface thereof, a horizontal center portion of a bottom member spaced from said top member, and two spaced upwardly converging laterally positioned ribs connecting said top and bottom members with an upper end of each of said ribs joining said top member beneath an outer rim of said center plate so as to provide clear passage through said center cavity below said center plate of said truck bolster.

2. A truck bolster as defined by claim 1 and further characterized by said bolster further comprising, spaced sidewalls connecting with said top and bottom members and said ribs, said sidewalls located transversely to said ribs and having a substantial opening in said sidewalls positioned between said ribs and said top and bottom members to provide access to a clear passage through said center cavity between said openings, and a pair of reinforcing gussets formed on each said rib with said gussets extending beneath said top member and each gusset having an outer edge proximately aligning with said openings in said sidewalls.

3. A tubular-type bolster for a railway car truck comprising, a top horizontal member, a center plate carried by said top member at a center point thereof, a bottom member having an inverted gull-winged configuration joined to said top member by two vertically spaced sidewalls, said bottom member including a horizontal center portion having ends extending beyond an outer rim of said center plate, and intermediate portions joining respective ends of said center portion on an upward obtuse angle as formed with a plane of said center portion of said bottom member, two spaced ribs connected to said sidewalls and positioned laterally between said top and bottom members and having a lower end integrally joining said bottom member at a proximate adjacency of said center portion and said intermediate portions of said bottom member, respectively, and an upper end integrally joining with said top member and positioned to proximately align with an outer rim of said center plate, said ribs each having a pair of gussets formed thereon with each said gusset selectively projecting inwardly, a selectively sized opening formed in said sidewalls of said bolster, respectively, said openings having a center point aligned with a vertical axis of said center plate and sides proximately aligned with an outer edge of said gussets and with an outer rim of said center plate and a top and a bottom spaced below said top member and above said bottom member respectively, wherein said gussets and said openings in said sidewalls form a large clear passage through a center cavity beneath said center plate.

4. A bolster as defined by claim 3 and further characterized by comprising, spaced indentations formed on an outer surface of said bottom member, said indentations aligned with a longitudinal axis of said bolster body and positioned below said junction of said rib and said bottom member, respectively.

5. A bolster as defined by claim 3 and further characterized by, said ribs joining said top and said bottom members to form inner and outer radius corners having substantial diameters.

* * * * *